US005873410A

United States Patent [19]

Iato et al.

[11] Patent Number: 5,873,410

[45] Date of Patent: Feb. 23, 1999

[54] METHOD AND INSTALLATION FOR PUMPING AN OIL-WELL EFFLUENT

[75] Inventors: Michel Iato, Pau; Alain Viard, Montardon, both of France

[73] Assignee: Elf Exploration Production, France

[21] Appl. No.: 889,586

[22] Filed: Jul. 8, 1997

[30] Foreign Application Priority Data

Jul. 8, 1996 [FR] France ..... 96 08478

[51] Int. Cl.[6] ..... E21B 43/12

[52] U.S. Cl. ..... 166/54; 166/68

[58] Field of Search ..... 166/54, 53, 67, 166/68, 372, 105, 105.5

[56] References Cited

U.S. PATENT DOCUMENTS

| | | | |
|---|---|---|---|
| 1,499,589 | 7/1924 | Navin . | |
| 2,986,215 | 5/1961 | Barr | 166/67 |
| 3,894,583 | 7/1975 | Morgan | 166/68 |
| 4,384,962 | 5/1983 | Harris | 210/788 |
| 4,390,061 | 6/1983 | Short | 166/53 |
| 4,420,392 | 12/1983 | Harris | 210/86 |
| 4,497,714 | 2/1985 | Harris | 210/788 |
| 4,585,060 | 4/1986 | Bernardin et al. | 166/64 |
| 4,766,957 | 8/1988 | McIntyre | 166/265 |
| 4,791,985 | 12/1988 | Flores Bermudez | 166/68 |
| 5,161,956 | 11/1992 | Fiedler | 417/86 |
| 5,183,391 | 2/1993 | Fiedler | 417/118 |
| 5,238,060 | 8/1993 | Niehaus et al. | 166/68 |

*Primary Examiner*—Frank Tsay
*Attorney, Agent, or Firm*—Bacon & Thomas, PLLC

[57] ABSTRACT

Installation for pumping a liquid coming from an underground source, comprising a well (10) extending from the surface (12) towards the liquid source (14), the well having a chamber (40) extending substantially over its entire length, at least one tubing (18) passing through the chamber and communicating with the latter, and a set of valves (34), which is intended for putting the chamber selectively in communication with a gas source at a first pressure (36), making it possible for the liquid coming from the source to fill the chamber, and a gas source at a second pressure (38) higher than the first pressure, in order to empty the chamber, the liquid being delivered towards a first outlet (30) by flow through the tubing, characterized in that the said installation comprises, furthermore, a shutter (52), mounted in the tubing (18), and a second conduit (58; 70) leading to a second outlet (74), the shutter being capable of reacting to the density of fluid surrounding it, so that it can deliver a first liquid towards the first outlet (30), a second liquid of higher density being delivered towards the second outlet (74) via the second conduit (58; 70).

5 Claims, 3 Drawing Sheets

METHOD AND INSTALLATION FOR PUMPING AN OIL-WELL EFFLUENT

BACKGROUND OF THE INVENTION

The present invention relates to a method for pumping a liquid effluent and, more particularly, to a method for pumping hydrocarbons coming from an oil well.

The present invention also relates to an installation for pumping an oil-well effluent coming from an underground source.

DESCRIPTION OF RELATED ART

In some oil wells, the natural flow of the hydrocarbons from the bottom to the surface proves insufficient to allow or maintain commercial production. This is due either to the high viscosity of the hydrocarbons or to too low a natural pressure at the bottom of the well or even to a combination of both of these. The inrushes of water into the well may also limit the natural flow of the hydrocarbons. In order to make it possible for the well to be put into production on a commercial scale, it is expedient to employ a well assistance system or a well activation system. For example, a pump may be mounted at the lower end of a production tube located in the well, or an installation for injecting gas at the bottom of the well may be provided. This last type of installation, more commonly known as "gas lift", serves to lighten the hydrocarbon column located in the well, in order to make it easier to raise it towards the surface.

However, these two assistance systems require the use of appliances or installations in the well, which is a place where the temperatures and pressures are very high and where the ambient medium may be highly corrosive. These conditions prevailing at the bottom of the well cause failures or malfunctions of the activation equipment, which, in view of its location in the well, necessitate long and costly servicing work. Moreover, during this work, the production of the well is stopped, thereby incurring additional financial losses.

Another assistance system involves pumping the hydrocarbons from the surface. The document EP-A-579,497 describes a method for pumping liquid, coming from one end of a well, towards an outlet at the opposite end of the well, in which method the gas pressure in one or more chambers is regulated so that they fill with liquid. A higher gas pressure is subsequently applied to each chamber in order to displace the liquid and convey it towards the outlet. Each chamber is provided with inlet and outlet valves controlled from level detectors, for the purpose of controlling the direction of flow of the liquid. According to this document, the chambers may either be superposed one on another inside the well or be arranged side by side at a point adjacent to the outlet of the well.

Positioning the chambers in the well in a superposed manner has advantages, in that it makes it possible to have a less bulky installation and optimized energy efficiency. By contrast, this type of installation has disadvantages, since the superposition of the chambers, each being provided with various valves and with level detectors, makes it necessary to remove one or more chambers from the well when there is a failure or breakdown in one of the lower chambers. Furthermore, the use of a plurality of chambers, each equipped with valves and with level detectors, makes it difficult to estimate the maintenance of the installation.

The document U.S. Pat. No. 1,499,509 describes a method for pumping an effluent coming from a low-eruption oil well. According to this method, the effluent fills an annular space defined between the wall of the well and production tubing which extends from the bottom of the well to the surface. Once the annular space is filled with effluent, pressurized gas is conveyed from the surface into the upper end of this space, thus causing the effluent to be displaced and raised to the surface through the interior of the tubing.

However, this type of method has disadvantages, in that it does not allow for the fact that most of the effluents coming from an oil well contain, above all at the end of the life of the deposit, a large quantity of water which may bring the natural production of the well to a stop or limit the effectiveness of the gas lift. It is desirable to have the possibility of separating the water from the hydrocarbons at the bottom of the well, so that it is possible for only the hydrocarbons to be raised to the surface.

SUMMARY OF THE INVENTION

The object of the present invention is a pumping installation allowing the pumping method to be carried out.

In order to achieve this object, the invention provides an installation for pumping a liquid coming from an underground source, comprising a well extending from the surface towards the liquid source, the well having a chamber extending substantially over its entire length, at least one tubing passing through the chamber and communicating with the latter, and a set of valves, which is intended for putting the chamber selectively in communication with a gas source at a first pressure, making it possible for the liquid coming from the source to fill the chamber, and with a gas source at a second pressure higher than the first pressure, in order to empty the chamber, the liquid being delivered towards a first outlet by flow through the tubing, characterized in that the said installation comprises, furthermore, a shutter, mounted in the tubing, and a second conduit leading to a second outlet, the shutter being capable of reacting to the density of fluid surrounding it, so that it can deliver a first liquid towards the first outlet, a second liquid of higher density being delivered towards the second outlet via the second conduit.

The present invention has the advantage of making use of an installation requiring, above all as regards the components installed in the well, infrequent maintenance which can be carried out in a simple way from the outlet of the well.

Other characteristics and advantages of the present invention will emerge from a reading of the following description given by way of non-limiting explanation and made with reference to the accompanying drawings.

BRIEF DESCRIPTION OF THE FIGURES OF DRAWINGS

DETAILED DESCRIPTION OF THE PREFERRED EMBODIMENT

Figures 1, 1A:
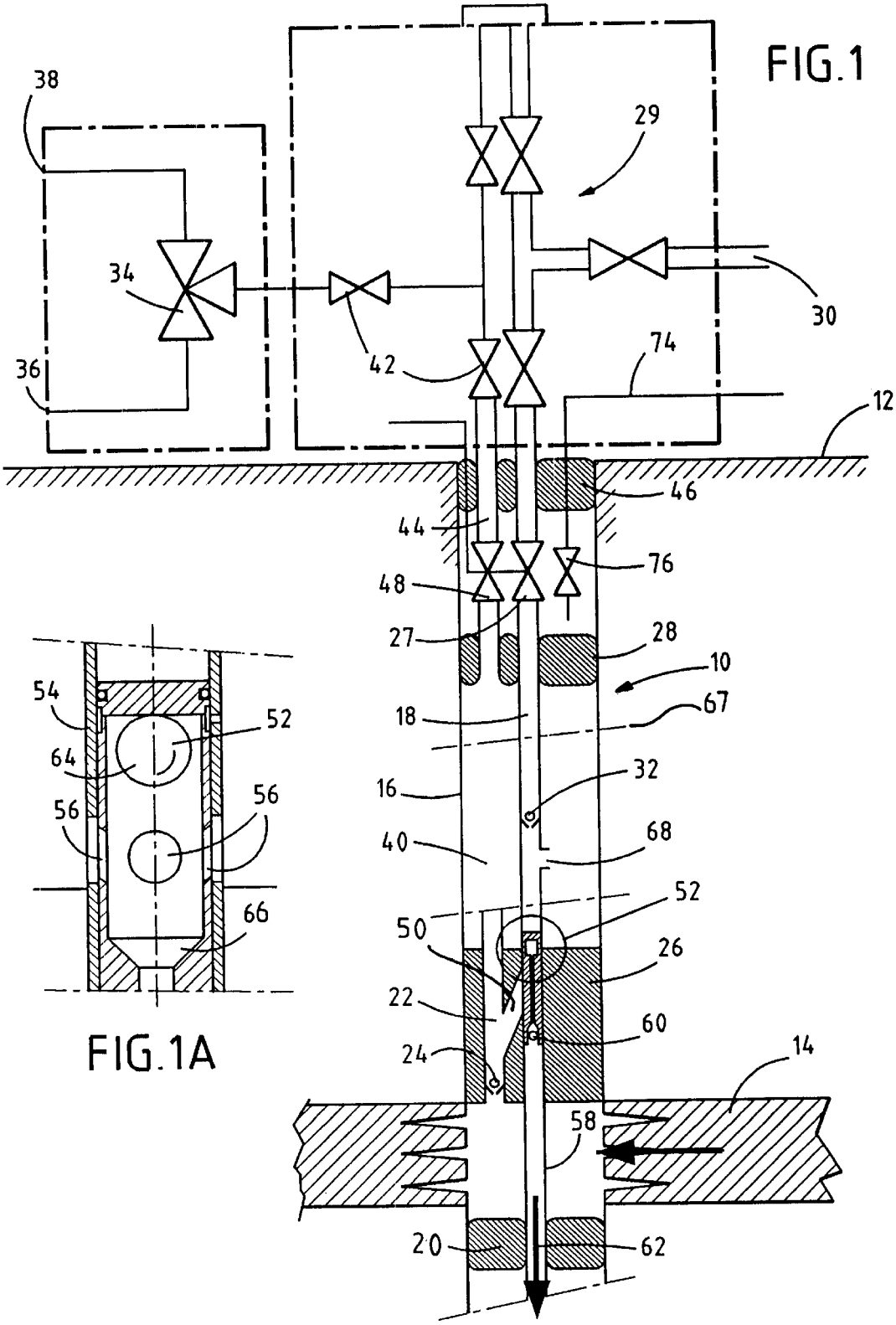
FIG. 1 is a diagrammatic sectional view of a well according to a first embodiment of the invention.
FIG. 1A is a detailed view of an element of FIG. 1.

In FIG. 1, a well, shown as a whole at 10, which, in the example illustrated, is an oil well, extends from the ground surface 12, which may be the bottom of the sea, towards a seam of reservoir rock 14. The well 10 is provided with a casing 16 extending along the well and with a production tubing 18 extending from the surface 12 towards a point below a seal 20, known as a packer, mounted sealingly in the casing at a point located a few meters or a few tens of meters below the reservoir rock 14. A conduit 22, provided with a non-return valve 24, is arranged in a seal assembly 26, or packer, mounted in the well around the tubing 18 at a point above the rock seam 14. The tubing 18 comprises, at a point located approximately 100 m from the surface 12, a safety valve 27 arranged immediately above a second packer 28 advantageously mounted in the well. The tubing 18 comprises, at its upper end, a set of production valves 29, or "Christmas tree", which is intended for controlling the production rate of the well and for ensuring its safety. This set of valves communicates with a production conduit 30 forming the outlet of the well. Moreover, the tubing 18 comprises, towards its lower end, a non-return valve 32 intended to make it possible for the liquid to flow only towards the outlet 30.

At the surface 12, a distribution system, formed, for example, from a set of control valves 34, is connected to a low-pressure gas source 36 and a high-pressure gas source 38. The pressure of each of the two gas sources 36 and 38 is selected as a function of the characteristics of the well, for example its depth, or of the pressure of the deposit. As will be described in more detail below, these characteristics change with time during the production phase of the well. It is therefore necessary for the gas pressures used to be modified correspondingly as a function of time.

The set of valves 34 communicates with the annular space 40, or chamber, defined between the casing 16 and the tubing 18 and delimited by the packer 28 and the seal assembly 26, by means of safety valves 42 and a conduit 44 which passes through a tubing suspension seal 46, or "tubing hanger", mounted at the upper end of the well. A safety valve for the annular space 48 may be mounted at the end of the conduit 44.

The seal assembly 26 is provided with a device making it possible to reinject the water, in the example illustrated the said device being a shutter 52, shown in more detail in FIG. 1A. This shutter 52 comprises a tubular body 54 substantially in the extension of the tubing 18 and provided with lateral orifices 56, four in the example illustrated, which put the annular space 40 in communication with the lower end 58 of the tubing 18. This lower end 58 is provided with a non-return valve 60 which allows fluid coming from the annular space 40 to flow in the direction of the arrow 62 towards an aquifer (not shown) underlying the reservoir 14. The shutter 52 comprises a ball 64 which is designed to come into abutment on a seat 66 formed in the body 54, thus closing the passage towards the lower end 58 of the tubing 18. The density of the ball 64 is selected so as to be higher than that of the liquid hydrocarbons coming from the reservoir rock 14, but lower than that of the water. This density, which is in the neighbourhood of 0.9, results in the ball 64 floating in the water, but, when it is in the presence of hydrocarbons, it descends onto the seat 66, thus closing the lower end 58 of the tubing 18. A conduit 50 in the seal assembly 26 allows access to the shutter 52 for any maintenance operations.

The method for putting the installation thus described into practice is as follows:

In a first step, the annular space 40 is put in communication with the low-pressure gas source 36 by means of the set of control valves 34. The low pressure prevailing in the annular space 40 makes it possible for the mixture of hydrocarbons and of water, forming the effluent coming from the reservoir seam 14, to rise inside the well through the valve 24 and the conduit 22, filling the annular space 40 as far as an upper intermediate level 67 and thus forcing back the low-pressure gas from the reservoir towards its source. Since the installation is not provided with sensors for sensing the level of the hydrocarbons, this intermediate level is determined as a function of the characteristics of the reservoir, of the pressure of the gas and of time. Since the time necessary for the hydrocarbons to reach their stabilization level is very long, an intermediate level, which is below the maximum possible level and which the hydrocarbons reach after a predetermined time, is employed.

The effluent coming from the reservoir rock 14 comprises a mixture of hydrocarbons and of water. During the period in which the annular space 40 is filled, the hydrocarbons separate from the water which, being denser, collects towards the lower end of the annular space 40. Since the ball 64 of the shutter 52 is in the water, it lifts off from its seat 66 and opens the passage from the annular space towards the aquifer which, however, cannot fill the annular space on account of the valve 60.

Once this filling/separating time has elapsed, the set of control valves is actuated in order to isolate the annular space 40 from the low-pressure gas source 36 and put the said annular space in communication with the high-pressure gas source 38. The gas pressure in the upper end of the annular space 40 acts on the hydrocarbons and the water and tends to push them back towards the bottom of the well, the non-return valve 24 preventing the liquids from returning towards the reservoir 14.

When the effluents in the annular space 40 are displaced downwards by the high-pressure gas, the water located towards the lower end of the annular space passes via the shutter 52 towards the aquifer in the direction of the arrow 62, the interior of the well 10 being isolated from the aquifer by means of the seal 20. Once the water has been displaced from the annular space and the hydrocarbons reach the lower end, the ball 64, which is in a less dense medium, descends towards its seat 66, closing the passage towards the aquifer. Once this passage is closed, the hydrocarbons displaced by the high-pressure gas pass through an orifice 68 made in the tubing 18 at a point above the shutter 52 and rise towards the outlet 30 at the surface 12. It should be noted that the expulsion of the two phases may take place simultaneously, depending on the profile of the change of pressure in the annular space 40 and on the characteristics of the well (aquifer pressure, wellhead pressure, etc.).

Thus, according to the invention, a large part of the water coming from the reservoir 14 will be reinjected into an underlying aquifer, thereby appreciably improving the hydrocarbon content of the effluent raised to the surface.

An intermediate level is determined as a function of the counterpressure along the discharge line, of the pressure of the gas, of the geometrical characteristics of the well and of time. In fact, once again, the time necessary for the hydrocarbons to reach a stabilization level, which must be located above the orifice 68 to avoid recirculation of the high-pressure gas, is very long. An intermediate level, which is above the minimum possible level and which the hydrocarbons reach after a predetermined time, is therefore employed. Once this time has elapsed, the set of valves 34 is actuated once again, and the annular space 40 is isolated from the high-pressure gas source 38 and put in communication with the low-pressure source 36. Thus, the gas pressure in the annular space 40 decreases rapidly, allowing the liquids coming from the reservoir to begin once more to fill this space 40. The operating cycle described above is subsequently repeated. Since the pressure of the well changes with time, it is necessary to conduct periodic measurements of the static pressure of the well, in order to modify the gas pressures correspondingly.

So as to smooth out the production of hydrocarbons, but also the consumption of high-pressure gas, over time, two or more wells, or well assemblies, may be provided, which are connected to a common outlet 30 and which are arranged in such a way that, when one is in the blow-off phase, the others are in the filling phase. The number of wells, or well assemblies, will then be determined as a function of the comparative durations of the two phases, so as to optimize the overall production rate.

Figure 2:
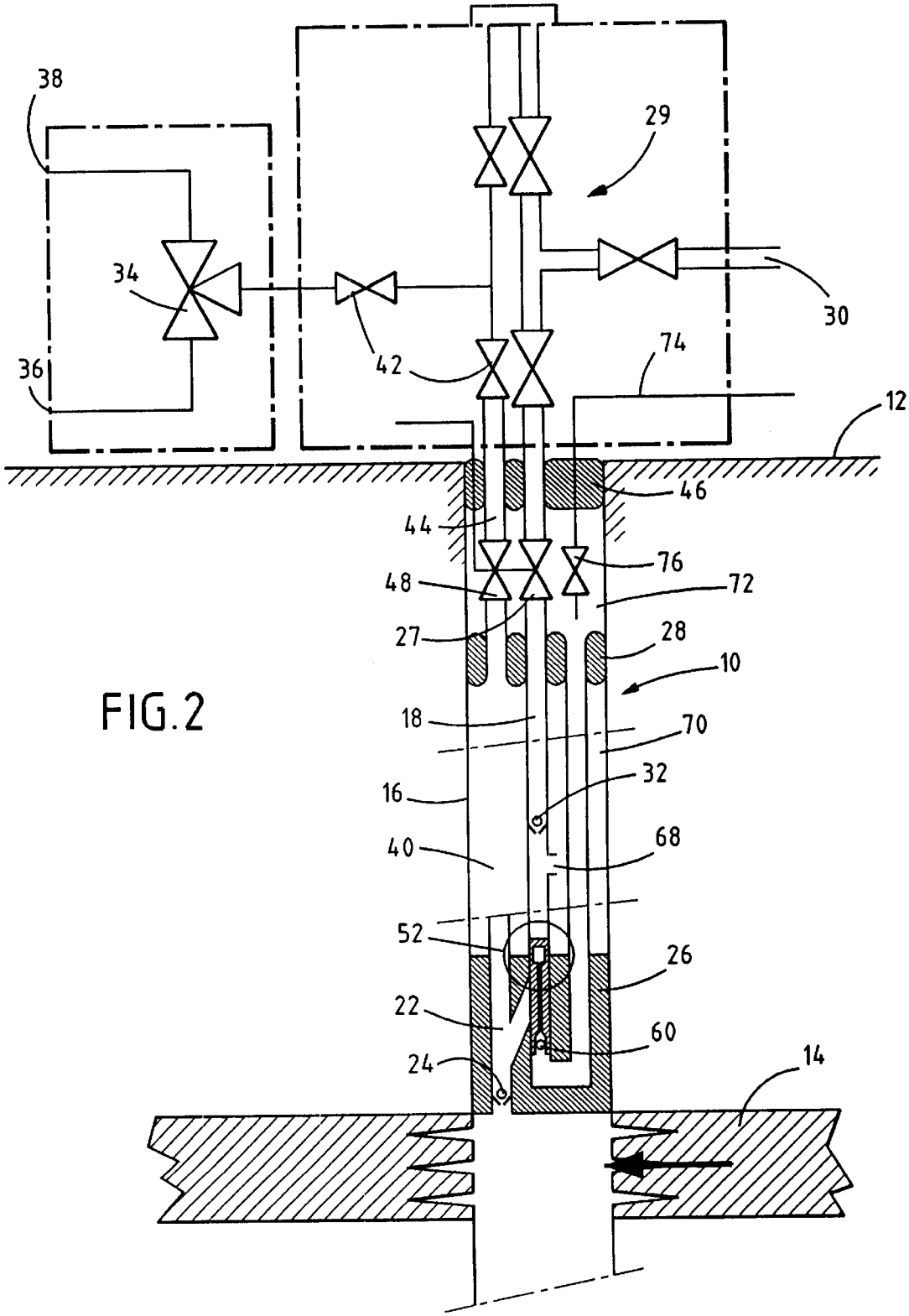
FIG. 2 is a diagrammatic sectional view of a second embodiment.

FIG. 2 shows an installation for an oil well, which, contrary to that of FIG. 1, does not have an underlying aquifer towards which the water coming from the reservoir rock 14 can be forced back. In this Figure, the elements common to those of the installation of FIG. 1 bear the same reference numerals.

As shown in FIG. 2, the tubing 18, instead of being extended by a lower end 58, communicates, inside the seal assembly 26, with a second tubing 70. This second tubing 70 extends from the seal assembly 26 through the packer 28 and opens into a chamber 72 delimited between the packer 28 and the tubing suspension seal 46. This chamber 72 communicates with a common water reinjection or discharge device (not shown) via a conduit 74 provided with a safety valve 76. If the well is not provided with a packer 28, the second tubing 70 extends as far as the surface.

The method for putting the installation of FIG. 2 into practice is substantially similar to that for the installation of FIG. 1. Once the annular space is filled with effluent and the hydrocarbons have been separated from the water, the conveyance of high-pressure gas into the annular space 40 displaces the liquids present in this space downwards. In a first step, the water located at the lower end of the annular space is delivered towards the water reinjection device by means of the second conduit 70, the chamber 72 and the conduit 74, the shutter 52 being open. It should be noted that, during this phase, the static pressure exerted on the water by the hydrocarbon column present in the annular space is added to the pressure of the gas in the annular space. This additional static pressure makes it easier for the water to rise towards the surface.

Once the level of hydrocarbons has fallen as far as the shutter 52, the ball 64 closes on its seat 66. From this moment, the hydrocarbons are delivered towards the outlet 30 by the high-pressure gas by means of the orifice 68 and the tubing 18. The rest of the method is similar to that regarding the installation of FIG. 1. As in the preceding example, expulsion of the two phases may take place simultaneously.

The pumping method and installation according to the invention may apply to wells at sea or wells on land and to vertical or inclined wells. It should be noted that this device also allows an at least partial separation of the gas dissolved in the effluent coming from the reservoir 14, the gas thus separated rising via the conduit 44 towards the low-pressure gas reservoir 36.

Alternatively, with physical separation between phases being carried out at the bottom, delivery towards the surface could take place via a single conduit, the arrival of the phases in sequence allowing them to be treated individually at the wellhead, in order to convey the phases towards their respective outlets.

Figure 3:
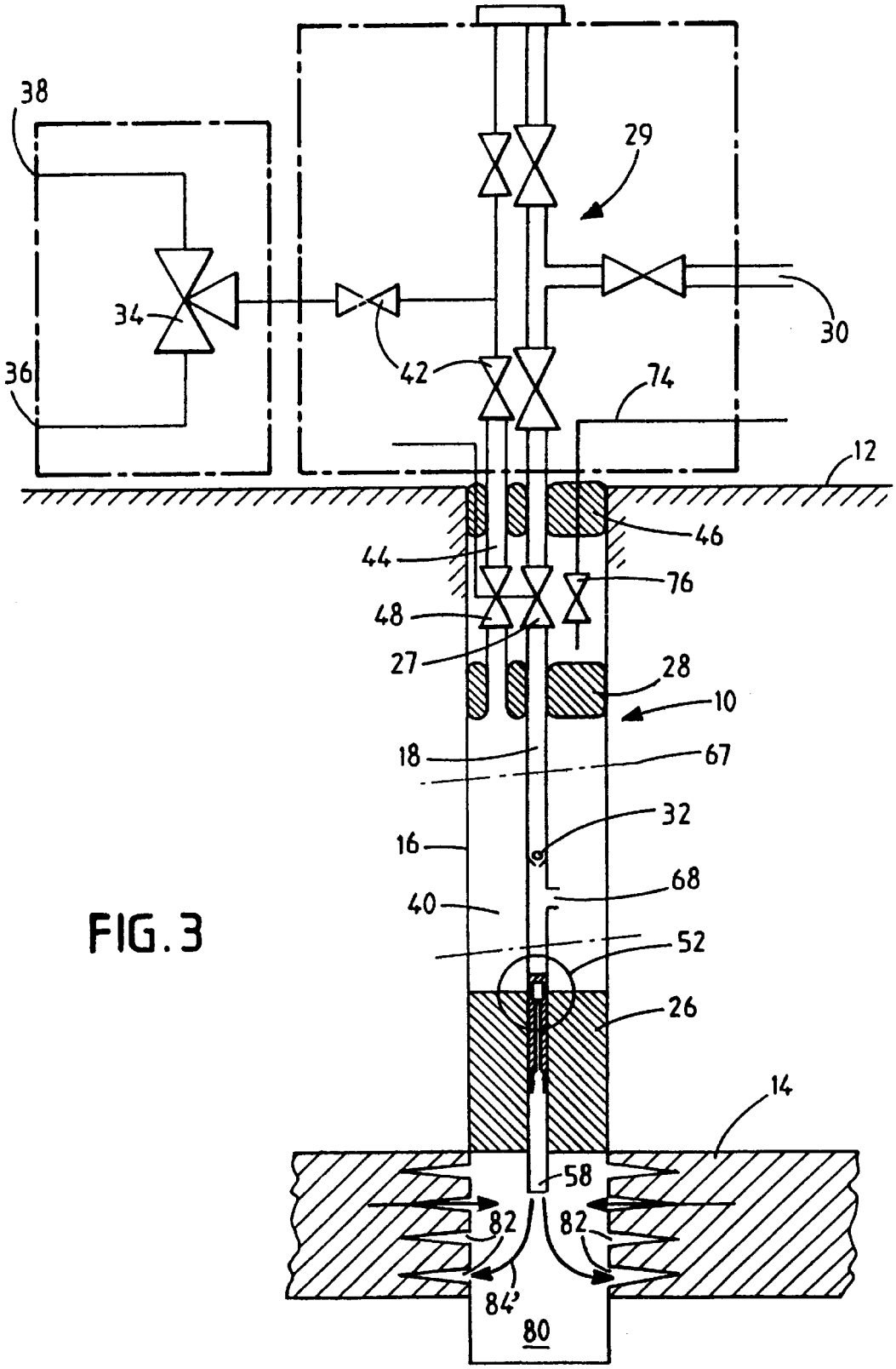
FIG. 3 is a diagrammatic sectional view of a third embodiment which is a variant of that of FIG. 1.

The embodiment of FIG. 3 differs from that of FIG. 1 in that the pumping installation is intended for delivering the water separated from the hydrocarbons towards the reservoir rock 14, instead of conveying it towards an aquifer, as in the installation of FIG. 1.

In FIG. 3, the elements already present in FIG. 1 bear the same reference numerals.

As shown in FIG. 3, the end 58 of the production tubing 18 opens, immediately below the seal assembly 26, into a chamber 80 defined in the lower end of the well 10. Perforations 82, formed in the seam of reservoir rock, open into the chamber 80. The seam of reservoir rock has a thickness greater than that of the embodiment of FIG. 1 and has very high permeability.

The pumping method carried out by using the installation of FIG. 3 is substantially similar to that of FIG. 1. After the separation phase, water is located towards the lower end of the annular space 40 and the shutter 52 is open. When gas coming from the high-pressure source 38 is conveyed into the annular space 40, the water is delivered by this gas, through the shutter 52 and along the end 58 of the production tubing 18, towards the chamber 80. The water subsequently penetrates, in the direction of the arrows 84, into the lower part of the rock seam 14 via the lower perforations 82. Thus, once the water has been propagated in the rock seam 14, it tends to displace or expel the hydrocarbons present in the rock towards the chamber 80 and then into the annular space 40.

It is claimed:

1. An installation for pumping liquid from an underground liquid source to the ground surface, comprising a well extending from the ground surface towards the underground liquid source, the well having a chamber extending substantially over its entire length said chamber having an upper end and a lower end, at least one tubing passing through the chamber and communicating therewith through an orifice, a first gas source at a first pressure, a second gas source at a second pressure, means for placing the chamber in selective communication with the gas sources such that when the chamber is in communication with the first gas source, liquid coming from the underground liquid source fills the chamber and when the chamber is in communication with the second gas source, the liquid in the chamber enters the tubing through the orifice and is directed towards a first outlet, a shutter mounted in the tubing below the ground surface at the lower end of the chamber and a second outlet in communication with the shutter via a second conduit, the shutter being capable of reacting to the density of fluid surrounding it such that it can deliver a first liquid towards the first outlet through the orifice in the tubing and a second liquid of higher density towards the second outlet through the second conduit.

2. The installation according to claim 1, wherein the shutter comprises a ball designed to shut off a seat in the second conduit, the density of the ball being of the order of 0.9.

3. The installation according to claim 1, wherein the second outlet communicates with an aquifer.

4. The installation according to claim 1, wherein the second outlet communicates with the underground liquid source.

5. The installation according to claim 1, said means for placing the chamber in selective communication with the gas sources comprises a set of valves.

* * * * *